United States Patent [19]

Strand et al.

[11] Patent Number: 4,991,979

[45] Date of Patent: Feb. 12, 1991

[54] FLEXIBLE INTERMEDIATE BULK CONTAINER WITH MEANS FOR PARTLY OF COMPLETE DISCHARGE

[75] Inventors: Olaf Strand; Bjarne Omdal, both of Porsgrunn, Norway

[73] Assignee: Norsk Hydro a.s., Oslo, Norway

[21] Appl. No.: 454,503

[22] Filed: Dec. 21, 1989

[30] Foreign Application Priority Data

Dec. 21, 1988 [NO] Norway ..... 885697

[51] Int. Cl.[5] ..... B65D 33/06; B65D 33/16

[52] U.S. Cl. ..... 383/25; 383/41; 383/67; 383/906

[58] Field of Search ..... 383/8, 25, 41, 67, 906

[56] References Cited

U.S. PATENT DOCUMENTS

| | | | |
|---|---|---|---|
| 3,282,621 | 11/1966 | Peterson | 383/67 X |
| 3,789,897 | 2/1974 | Saito | 383/41 X |
| 3,961,655 | 6/1976 | Nattrass et al. | 383/41 X |
| 4,224,970 | 9/1980 | Williamson et al. | 383/41 X |
| 4,269,247 | 5/1981 | Omdal | 383/8 |
| 4,573,204 | 2/1986 | Polett | 383/41 |

FOREIGN PATENT DOCUMENTS

| | | | |
|---|---|---|---|
| 2512014 | 9/1976 | Fed. Rep. of Germany | 383/41 |
| 138134 | 4/1978 | Norway . | |
| 2030958 | 4/1980 | United Kingdom | 383/67 |

*Primary Examiner*—Stephen Marcus
*Assistant Examiner*—Jes F. Pascua
*Attorney, Agent, or Firm*—Wenderoth, Lind & Ponack

[57] ABSTRACT

A flexible intermediate bulk container includes at least one lifting loop and a double base made of two bottom parts that can be direct extensions of sidewalls of the container. The bottom parts have openings positioned directly one above the other, thus forming an opening in the base. In between the bottom parts it is arranged a closure of flexible material with projections on each side of one end. The projections of the closure are fastened to the base by joints or seams. The other end of the closure has a handle. The closure can be made of woven fabric of similar or the same type as that of the container.

13 Claims, 1 Drawing Sheet

FLEXIBLE INTERMEDIATE BULK CONTAINER WITH MEANS FOR PARTLY OF COMPLETE DISCHARGE

BACKGROUND OF THE INVENTION

The present invention relates to a flexible intermediate bulk container (FIBC) having a double base construction and suitable for partial or complete discharge of bulk material.

An FIBC can be emptied either by using a long handled knife to cut one or more slits in the bottom or by lowering the FIBC onto a pyramidal shaped knife. These methods will destroy the base of the container and it cannot be reused. Further, by such method the entire contents of the FIBC will be discharged in a matter of seconds. This is not always desirable because the FIBC can contain 500–1500 kilos of bulk material. Partial discharge of bulk materials can, for various reasons, be desirable.

Norwegian patent No. 138,134 describes a FIBC with a double base construction. The FIBC comprises a sidewall structure with flaps which are integral extensions of the side wall fabric. Such flaps are joined two and two at their lower edges in such way that joining lines thereof cross at one point. Thus, the integral extensions of the pairs of equally large flaps form a double overlapping base.

Partial discharge of a FIBC will a single base construction and a discharge spout is a relatively simple operation. A great disadvantage related to this method is the need for working close to the base of a hanging container when the base mouth is opened or closed.

There has been developed a piece of board, for instance made of plastic material, to be used for partial discharge of a FIBC with a double base. This piece of board has a central opening and a handle at least at one end. The board is positioned between the flaps forming the double base. When the FIBC is emptied, a cut is made through the central part of the base. The bulk material flows freely out of the container when the opening in the board is positioned in the same position as the opening in the base of the container. The discharge is stopped and regulated by pulling or pushing the board away from the opening, and thus closing and opening in the base. In addition to the disadvantage of the necessity of working close to the base of a hanging container, this method also involves the disadvantage that the base is destroyed and the container is not reusable. A further disadvantage is that when the cut is performed some fabric from the base will pollute the bulk material. Also, the board has to be supplied separately to users, it cannot be an integral part of every container.

SUMMARY OF THE INVENTION

An object of the present invention is to provide a flexible bulk container with a double base and which can be emptied partly or completely without destroying the container base fabric and which is safe is use. Another object is to avoid polluting the bulk material with fabric of the container.

The inventors began the development of the invention by a close examination of the present methods for partial discharge of container. A further development of the discharge spout was not regarded to be convenient. The use of a board was more interesting. The inventors made permanent openings in the base of a container and then tried to find solutions to regulate or close the opening of the container. After having tested various types of boards, a board made of flexible material and fastened to the base was found to be the most appropriate. By fastening a piece of woven material to one end of the base and folding it double in between the double base structure, there is formed a closure that will cover the permanent opening in the base. The bulk material can pass through the opening in the base by pulling out that part of the closure not fastened to the base. The opening can be closed or partly closed by pushing the closure back toward its original position. This can be done by using a board positioned between the double base and between the layers of the closure.

BRIEF DESCRIPTION OF THE DRAWINGS

The invention will be described in more detail by way of example only, with reference to the drawings, wherein.

DETAILED DESCRIPTION OF THE INVENTION

Figure 1:
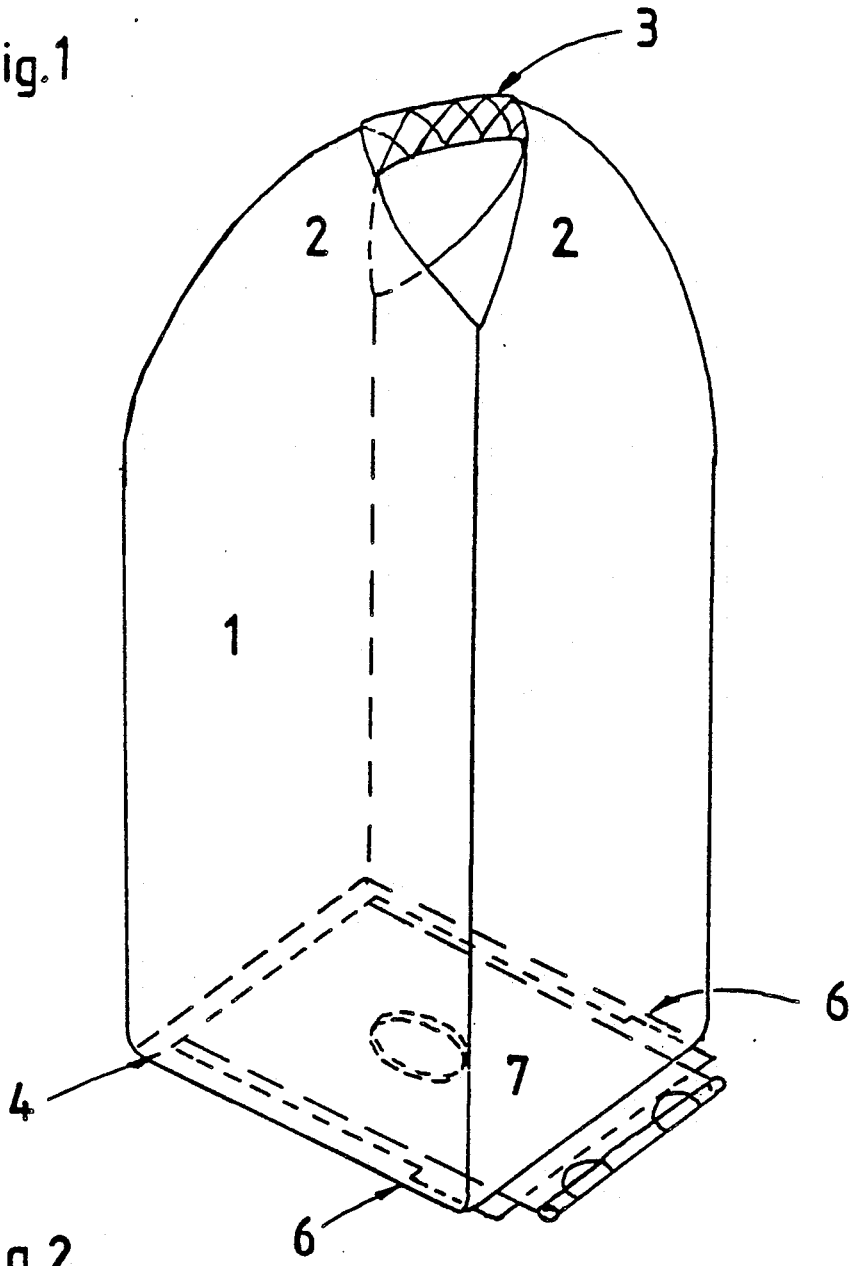
FIG. 1 is a perspective view illustrating an FIBC with a double base structure and a flexible sheet closure.

FIG. 1 illustrates an FIBC 1 including lifting loops 2 which preferably are integral extensions of side wall structure of the container. The lifting loop(s) can be supplied with a permanent lifting handle 3 such as a sleeve. The FIBC 1 has a double base comprising two bottom layers 4 which can be direct extensions of the side wall structure. In the center of each of the bottom layers 4 is provided an opening 5. The edges around the openings 5 can be reinforced, for instance by seams, to avoid separation of fibers. The two openings 5 are arranged directly above each other, thus forming a continuous opening in the base of the container.

Figure 2:
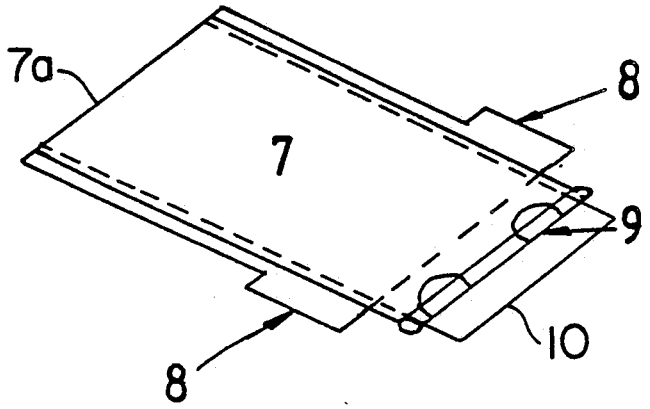
FIG. 2 is a perspective view illustrating in more detail the sheet closure seen in FIG. 1.

Along the edges of the base are sewn seams 6, each with a length approximately equal to the length of a projection 8 at the respective side of a flexible closure 7 (FIG. 2) formed of a flexible material and of a double layer or folded structure positioned between the two base sections 4. FIG. 2 illustrates in detail closure 7 of a flexible material, for instance woven fabric of the same type as the fabric used for the FIBC. The illustrated closure 7 is doubled and at one end of one layer are provided the two projections 8 for fixedly fastening the closure 7 to the base of the FIBC 1 by the seams 6. At the other end of the other layer of the closure 7 is a handle 9 which can have various shapes. FIG. 2 illustrates one example where the handle is a rod fastened to the closure 7.

When the FIBC is to be emptied of bulk material, it is lifted by a hook and the closure 7 is in the position as shown in FIG. 1 closing the openings 5. One person can very easily empty the container partly or completely by using the handle 9 to pull out the closure 7 (to the right in FIG. 1) such that a folded edge **7*a* between the two layers of closure 7 progressively moves across and unblocks openings 5. The bulk material will flow freely from the openings 5. The discharge can be stopped by pushing the closure 7 back to its original position. This is easily performed by pushing a board, etc., shown schematically at 10** in FIG. 2, back in between the double layered closure.

The invention provides a simple solution of how to obtain a double based FIBC which can be used several times. The container can be completely or partially discharged in a safe manner, because opening and closing of the discharge opening can be achieved without having to work below the FIBC. The FIBC is not destroyed during discharge, and it has means for partial or complete discharge that is an integral part of the container. It also is possible to avoid pollution of bulk material with fibers of the base of the FIBC.

We claim:

1. In a flexible intermediate bulk container including a double base structure formed by two layers one above the other, the improvement comprising:

each said layer having an opening therein, said openings being aligned one above the other and thus forming a discharge opening through said base structure;

closure means for selectively closing and partially or fully opening said discharge opening, said closure means comprising a member formed of flexible material folded to form two layers and positioned between said two layers of said base structure, said member having a first end fixedly fastened to said base structure and a free second end; and means at said second end of said member for pulling said member from a fully inserted position, whereat said two layers of said member block said discharge opening, in a direction outwardly of said base structure such that a folded edge between said two layers of said member progressively moves across and unblocks said discharge opening, during which said first end of said member remains fixedly fastened to said base structure.

2. The improvement claimed in claim 1, wherein said container also includes a side wall structure.

3. The improvement claimed in claim 2, wherein said two layers of said base structure are integral extensions of material of said side wall structure.

4. The improvement claimed in claim 1, wherein said container further includes at least one lifting loop.

5. The improvement claimed in claim 1, wherein said member includes projections extending laterally from opposite sides adjacent said first end, and said projections are fixedly attached to said base structure.

6. The improvement claimed in claim 5, wherein said projections are joined to said base structure by seams.

7. The improvement claimed in claim 6, wherein said seams extend parallel to said direction.

8. The improvement claimed in claim 6, wherein said seams comprise sewn seams.

9. The improvement claimed in claim 8, wherein said member and said base structure are formed of similar woven fabric material.

10. The improvement claimed in claim 1, wherein said means comprises a handle attached to said second end of said member.

11. The improvement claimed in claim 6, wherein said handle comprises a rod extending transverse to said direction.

12. The improvement claimed in claim 1, further comprising means for returning said member to said fully inserted position.

13. The improvement claimed in claim 12, wherein said returning means comprises a rigid element positioned between said two layers of said member.

* * * * *